US006279776B1

(12) United States Patent
Finkletaub et al.

(10) Patent No.: US 6,279,776 B1
(45) Date of Patent: Aug. 28, 2001

(54) DISPENSING APPARATUS

(76) Inventors: Elaine Finkletaub, Flat 3 16 Coleridge Road, London N8 3ED; Sara Sanders, Jawoocote Pk Ave, Purley Surrey, both of (GB)

( * ) Notice: Subject to any disclaimer, the term of this patent is extended or adjusted under 35 U.S.C. 154(b) by 0 days.

(21) Appl. No.: 09/485,161

(22) PCT Filed: Jun. 24, 1998

(86) PCT No.: PCT/GB98/01848

§ 371 Date: Jan. 22, 2000

§ 102(e) Date: Jan. 22, 2000

(87) PCT Pub. No.: WO99/05047

PCT Pub. Date: Feb. 4, 1999

(30) Foreign Application Priority Data

Jul. 23, 1997 (GB) ..... 9715401

(51) Int. Cl.[7] ..... B65G 59/00
(52) U.S. Cl. ..... 221/281; 221/306
(58) Field of Search ..... 221/281, 303, 221/306, 312 R, 312 C; 220/253

(56) References Cited

U.S. PATENT DOCUMENTS

| | | | | |
|---|---|---|---|---|
| 1,671,285 | * | 5/1928 | Hanna | 221/303 X |
| 2,214,437 | * | 9/1940 | Punte et al. . | |
| 2,328,246 | * | 8/1943 | Albion . | |
| 3,762,539 | | 10/1973 | Kerr . | |
| 4,171,753 | | 10/1979 | Vreede | 221/197 |
| 4,181,218 | | 1/1980 | Cox . | |
| 4,538,726 | * | 9/1985 | Pastva | 221/312 X |
| 4,544,063 | * | 10/1985 | Neward . | |
| 4,928,970 | | 5/1990 | Latimer, Jr. . | |
| 4,971,203 | | 11/1990 | Weinstein . | |
| 5,141,129 | * | 8/1992 | Jennings | 221/306 X |
| 5,372,267 | * | 12/1994 | Hofmann | 221/306 X |
| 5,794,817 | * | 8/1998 | Rosa | 221/281 |
| 5,947,345 | * | 9/1999 | Hofmann | 221/306 X |

FOREIGN PATENT DOCUMENTS

| | | |
|---|---|---|
| 1092506 | 4/1955 | (FR) . |
| 2677616 | 12/1992 | (FR) . |
| 1596528 | 8/1981 | (GB) . |
| 2101972 | 1/1983 | (GB) . |

* cited by examiner

*Primary Examiner*—David H. Bollinger
(74) *Attorney, Agent, or Firm*—John Wiley Horton

(57) ABSTRACT

A dispensing apparatus comprising at least two parts, with the first part (d) being releasably held within the second (g) of the two parts and the first and second parts can be moved relative to one another to display at least two apertures leading to a chamber for retaining articles which are to be dispensed from the apparatus. The apparatus is preferably for dispensing question cards for playing a jigsaw game.

1 Claim, 5 Drawing Sheets

DISPENSING APPARATUS

Figure 1:
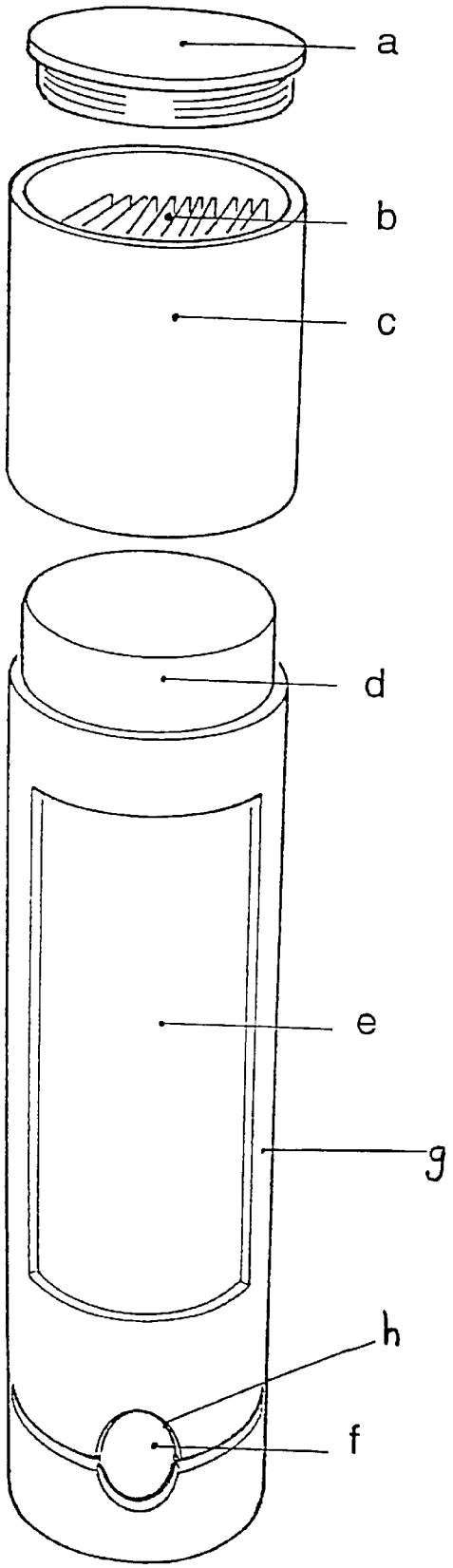

The present invention relates to a dispensing apparatus comprising at least two parts, a first of said two parts being releasably held within a second of said two parts, said first and second parts being moveable relative to one another to display at least two apertures leading to a chamber for retaining articles which are to be dispensed from the apparatus.

A known dispenser has a lid through which articles are inserted into the main dispenser. The lid is then closed and articles are removed either via an aperture associated with said lid, or through another aperture located in the dispenser. Such a known arrangement involves moving separate parts of the apparatus to open and close different apertures, thereby making the dispensing of articles complicated. In addition, it is usual that some type of separate closure is needed to prevent pieces falling out of such known dispensers. FR 1092506 shows a pushbutton dispenser having moving parts, the position of which are controlled by a spring.

The dispensing apparatus of the present invention, in contrast to known apparatus is easily operated so that the dispensing apparatus can be filled and also so that articles can easily be removed from the apparatus. In addition, relative movement of the parts of the dispensing apparatus of the present invention enables the apparatus to be closed securely so as to retain the articles in the apparatus without the need for a separate locking mechanism for the apparatus.

According to the present invention there is provided a A dispensing apparatus comprising at least two cylindrical parts (d,g), a first of said two parts (d) being releasably held within a second of said two parts (g), characterised by said first and second parts being moveable relative to one another in a helical fashion to display at least two apertures (i,f) leading to a chamber for retaining articles (b) which are to be dispensed from the apparatus, one of said apertures being in the first of said two parts (d) and the second aperture being in the second of said two parts (g), with said first aperture (i) being adjacent to a first end of the first part and said second aperture (f) being adjacent to a first end of the second part, said first and second apertures (i,f) being adjacent relatively opposed ends of said parts when one part is releasably held within the other, with the first part (d) also having access means to the chamber for retaining articles which is in proximity to the end of the second part having second aperture (f) and which on relative rotation of parts (d,g) said access means becomes aligned with aperture (f) so permitting access to the articles in the chamber.

According to a second aspect, the invention provides a dispensing apparatus which is used particularly but not exclusively for dispensing articles which are vertically stacked and may be adapted to dispense lamelliform articles. Such articles may be game pieces such as gaming cards.

In a preferred embodiment the apparatus of the invention comprises two tubes, one inserted within the other. The inner tube is moveable relative to the outer tube to enable an aperture in the inner tube to be revealed and also an aperture in said outer tube is opened.

In an alternative embodiment, the tubes and apertures may be arranged so that an aperture in the inner tube is opened and an aperture in said outer tube is revealed.

The relative movement between the inner and outer may involve a helical movement of the two tubes relative to one another and such helical movement causes the relative parts of the respective tubes which are covering apertures in said inner and outer tube to be displaced, thereby revealing the apertures. This helical movement reveals the two apertures which are situated adjacent first and second ends of the tubes. An aperture can then be used to remove articles from the dispensing apparatus. If required, articles can be inserted into the apparatus via an aperture. In a preferred embodiment, a first aperture is used to introduce articles into the dispensing apparatus while a second aperture is used to remove articles from the dispensing apparatus.

The contents in the tubes are preferably stacked thereby enabling the dispensing apparatus to operate with the benefit of the article being aligned with the apertures by gravity. Although the invention has been discussed with reference to two apertures it may be possible that more than two apertures are present in the dispensing apparatus. In such a case, the apparatus may comprise a series of compartments along its length with access apertures for each compartment.

In a preferred embodiment the apparatus has a further part which is attachable to the dispensing apparatus. This further part may be push fitted onto an end of the apparatus comprising first and second parts or alternatively, it may be clipped on to the end of said apparatus. This further part may comprise a storage chamber having a lid through which articles may be inserted and removed. The articles may be removed from the storage chamber, for use by an individual, or alternatively they may be inserted into the main dispensing apparatus comprising the two relatively moveable parts by means of a first aperture in the dispensing apparatus, preferably in the inner part. The articles may then be removed from the dispensing apparatus by means of a second of said apertures, preferably in a second part of the dispensing apparatus.

Preferred embodiments of the invention are illustrated in the drawings and will be described below by way of example. In the drawings:

FIG. 1. shows an exploded view of a dispensing apparatus according to the invention comprising first and second relatively movable parts, together with a storage chamber attached to the dispensing apparatus, with the apertures of the dispensing apparatus being closed.

Figure 2:
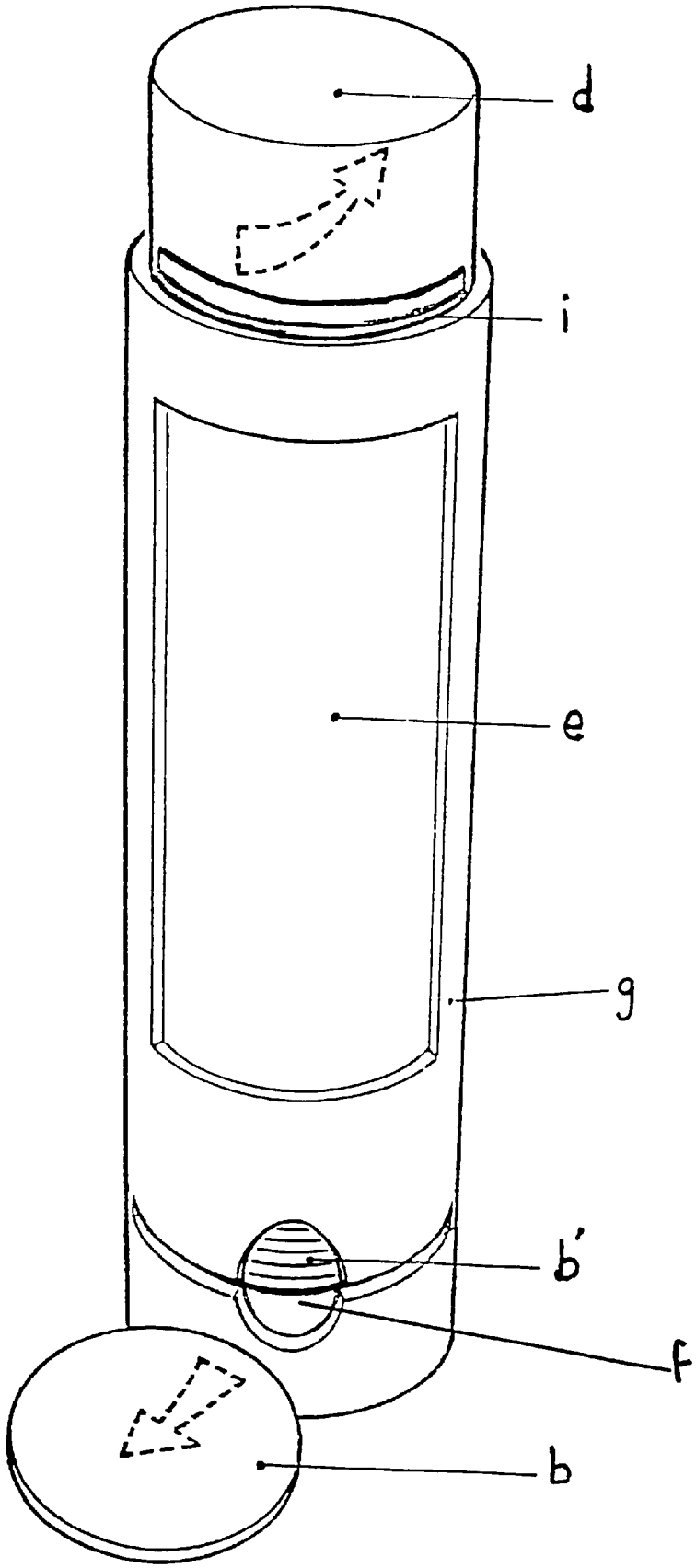

FIG. 2. Shows a dispensing apparatus as shown in FIG. 1 with the apertures being open.

Figure 3:
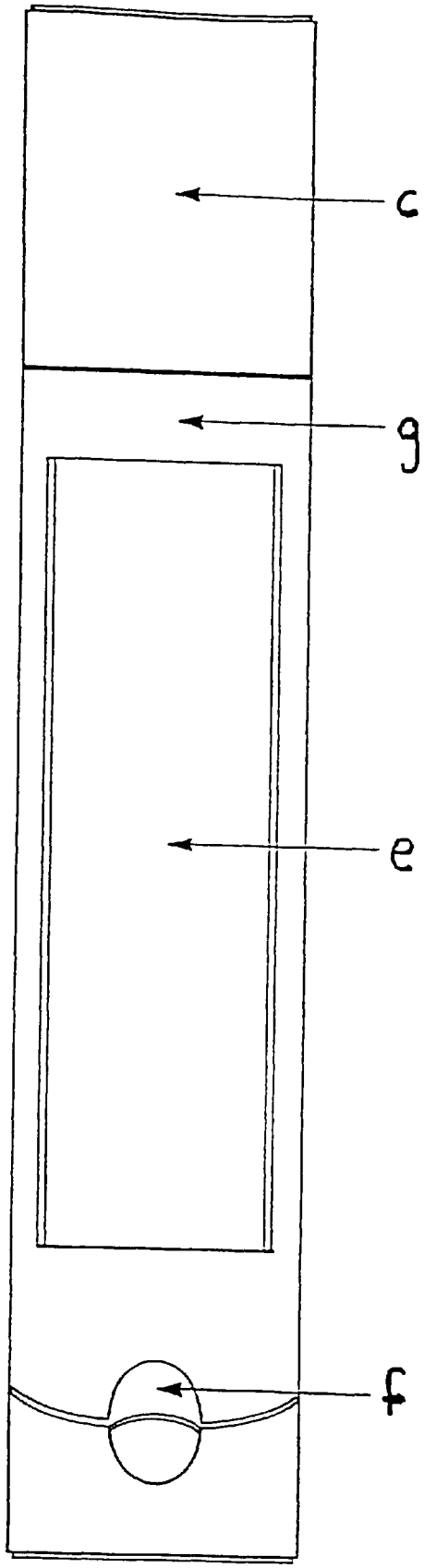

FIG. 3. Shows a side view of the dispensing apparatus as shown in FIGS. 1 and 2 with the storage chamber being attached.

Figure 4:
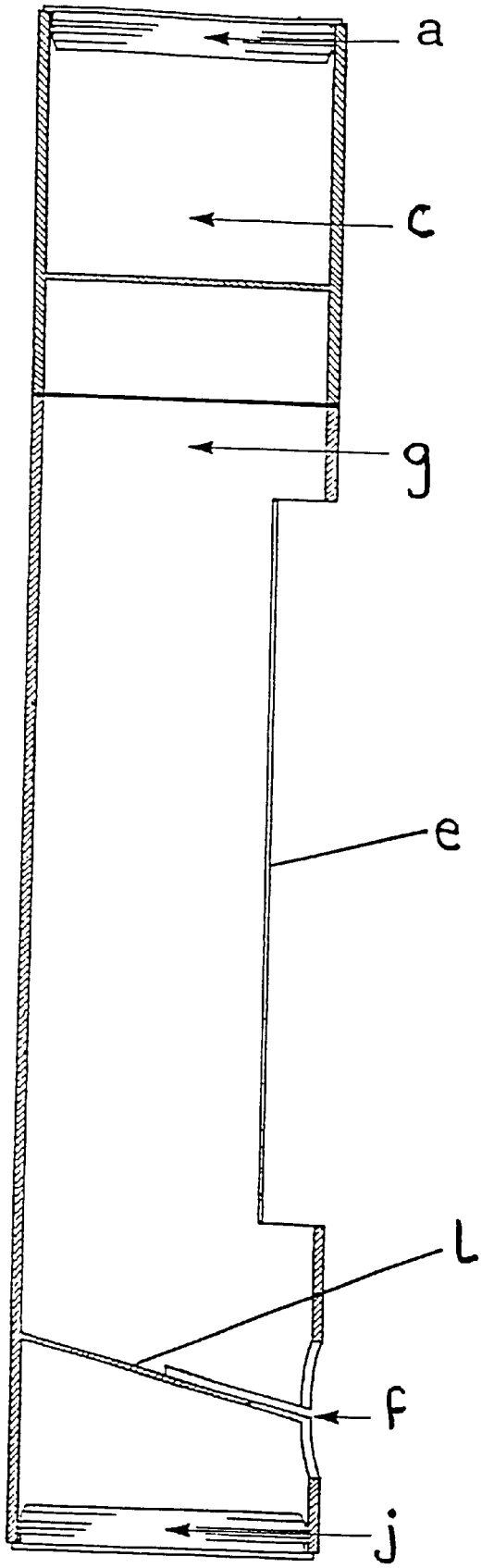

FIG. 4. Shows a section view of a second part of dispensing apparatus as shown in FIGS. 1 to 3.

Figure 5:
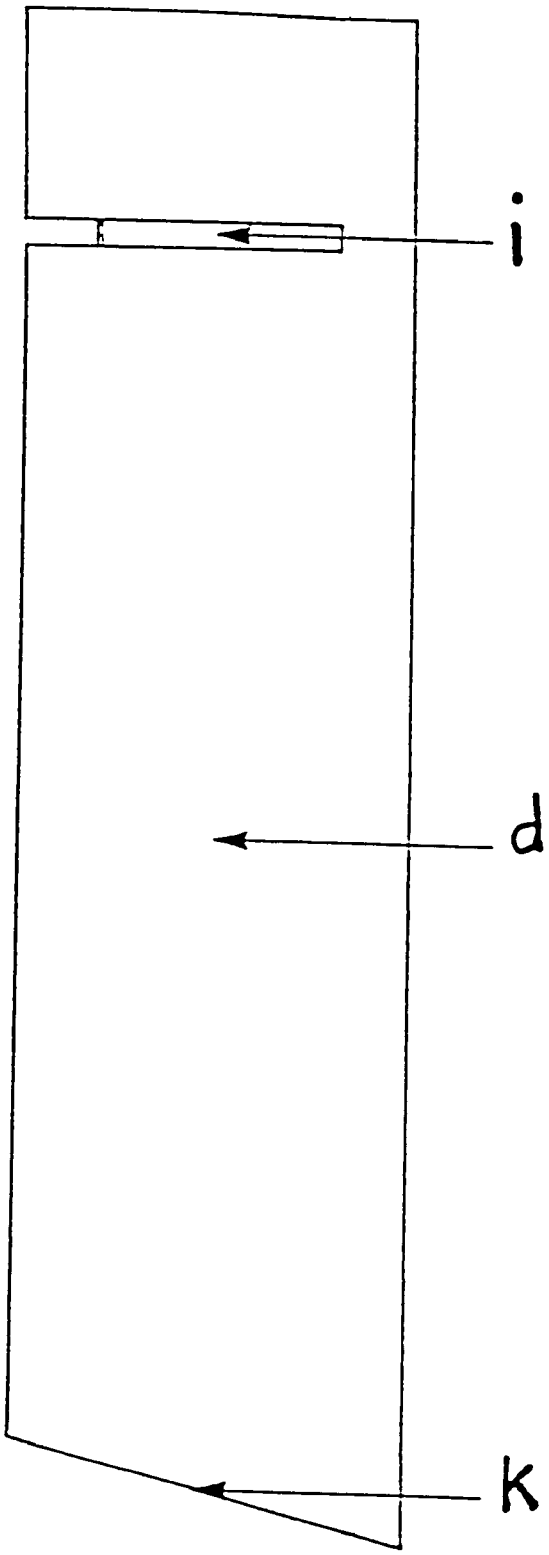

FIG. 5. Shows a first part of the dispensing apparatus according to the invention, said first part being insertable within the second part shown in FIG. 4.

FIG. 1 shows a dispensing apparatus according to an embodiment of the present invention. The apparatus comprises a first part d, which in this case is of a tubular shape, said first part being inserted within a second part g, which is also tubular. The second part g has an aperture f at a first of its ends for accessing articles contained within the dispensing apparatus and the aperture f has a widened part h for finger access, to grip articles within the dispensing apparatus. In this figure the aperture f is closed by the base of the first part d. The second part also has a display panel e, for displaying information about the articles contained within the dispensing apparatus.

The dispensing apparatus has a storage chamber c which is push fitted on a shoulder on the first part d of the dispensing apparatus. The storage chamber has a push fit lid a which retains articles b, within the storage chamber, alternatively a screw fit lid may be used. Articles may be removed from the storage chamber completely, or alternatively, they may be removed and then introduced into the dispensing apparatus through one of the apertures.

FIG. 2 shows the dispensing apparatus of FIG. 1, where the first and second parts have been moved relative to one another to reveal two open apertures f and i. The first and second parts are moved with a helical movement which in effect lifts inner part d to reveal the apertures. In revealing aperture f, articles b are now accessible and can be removed from the dispensing apparatus as shown.

FIG. 3 shows a side view of the apparatus according to an embodiment of the present invention with storage chamber c, being attached to the dispensing apparatus.

FIG. 4 shows a section view through a second part of a dispensing apparatus according to an embodiment of the present invention to which a storage chamber c, is attached. The storage chamber has a push fit lid a. The second part has a recess e, for holding information about the articles contained in the dispensing apparatus. Alternatively the recess may be a cut out which reveals information which is on the surface of the first part d. This information may be revealed by twisting the first and second parts relative to one another. Aperture f, is clearly shown, together with a cap j, preferably of a plastics material, for sealing a first end of part g. The aperture f in this embodiment, is cut at an oblique angle so that pieces may be easily withdrawn from the dispenser, however it is envisaged that in alternative embodiments, aperture f, is substantially horizontal to the base of the dispenser. Lying below the aperture f, is a wall 1, which is at an angle which is substantially parallel to the angle at which the aperture lies. In a preferred embodiment, the wall forms part of the wall which defines the aperture f. The wall 1, may be a solid wall substantially closing off the base of second part g, or it may be a partial wall, for example, extending as a shoulder around the circumference of the inside of second part g. Preferably the wall has an cut out in proximity to aperture f so that finger access to the dispenser is assisted.

FIG. 5 shows a section view through a first part d of a dispensing apparatus according to an embodiment of the present invention. The first part has an aperture i, for receiving articles to be held by the dispenser. Also shown is the open end k, of the first part, said end being at an oblique angle so as to give the base of the first part an oblique angled profile. The oblique angle of the base of first part interacts with the angled wall of the second part g as shown in FIG. 4. On rotating first part d relative to second part g the angled profiles of the first and second parts act against one another and consequently, part d is lifted relative to part g. This lifting movement causes aperture f to be opened and lifts aperture i above the end of part g to which storage chamber c, was attached before removal from part g. Rotation of first and second parts in the direction opposite to that used to display the apertures results in the apertures being concealed.

In an alternative embodiment of the invention, the end of the first part is closed, for example by means of a movable plate and articles held in the first part of the dispenser, are supported by a spring held on the base of the second part of the dispenser. The spring abuts against a plate supporting the articles to be removed from the dispenser and said sealing wall extends to cover aperture f. The force produced by the spring against plate supporting the articles causes the articles to be held so that they align with the aperture through which they are to be removed from the dispenser. Relative movement of parts d and g releases tension in the spring and so the wall supporting the articles can move upwards to reveal aperture f and aperture i in a single action. The shoulder on the inner circumference of second part g, enables controlled movement of the parts relative to one another by providing an area against which a person using the dispenser may purchase.

The embodiment of the present invention is used to dispense articles which are preferably vertically stacked. The stacked articles, by their weight, cause the lower articles of the stack to be pushed downwards so that they can be removed from the dispensing apparatus when it is held in a vertical orientation. The dispensing apparatus of the present invention can, in a preferred embodiment be used to dispense game pieces but it may have other applications such as dispensing thin, stackable objects such as wafer mints, coins, paper pieces, tickets or tokens or any combination of such articles. The dispensing apparatus may also have indicators such as a timer attached to one of its ends or to a storage chamber attached to it to indicate how long the articles have been held within the storage chamber. Also if the dispensing apparatus is used to dispense game pieces, the timer may be used to indicate the time that a player has to make a move in the game.

In a preferred embodiment the invention is used to dispense game pieces.

Inside the storage chamber there are a number of pieces, typically 54, for making up a plurality of miniature portraits/pictures and a typical number of portraits is six. Each miniature portrait is made up typically of 9 pieces and the pieces are jigsaw type pieces which may be interlocking or alternatively, pieces which are placed adjacent to one another to form a miniature portrait/picture. In a preferred embodiment the portraits are typically representations of celebrities. There are also optional "Challenge" cards, typically 150 and a set of rules. Question and answer cards are stored within the main body of the dispensing apparatus and as in this embodiment, celebrity portraits are to be made and the question and answer cards relate to celebrities. A typical number of question and answer cards is 495, although a greater or lesser number of cards can be included and the number of cards will influence the duration of play for the game.

The object of this embodiment of the invention is to be the first player or team to complete a miniature portrait of a celebrity from the pieces. This is achieved by correctly answering questions from celebrity question and answer cards.

The game is started by the removal of the storage chamber from the dispensing apparatus. The miniature portrait cards are withdrawn from the storage chamber and placed face down in no particular order. A player must then pick one which becomes the miniature portrait which that player must complete. The number of players is matched to the number of portraits to be completed. If there are six portraits, six players or teams of players may participate. If less than six players are participating the remainder of the miniature portraits cards are cast to one side.

A player must select a celebrity question and answer card from the aperture in the body of the dispensing apparatus and show the picture on the card to another player. The player answering must then decide how much knowledge they have of that particular celebrity and answer a question of the reverse of the card which are graded in varying degrees of difficulty i.e. Question 1=Easy; Question 2=Medium; Question 3=Difficult. As soon as the question is read the player has a set time, which typically is 30 seconds to answer. Either the player asking the question or another player must set the time which allows 30 seconds for answering the question. If the question is answered correctly the player is then entitled to pick up the number of pieces corresponding to the question they have answered i.e. a correct question at grade 1 (Easy) allows the player to pick up one piece making up the miniature portrait, a grade 2 question, two pieces and a grade 3 question, three pieces making up the miniature portrait.

However, the player may only retain one piece making up the miniature portrait. Other pieces collected on this turn are returned face down to the pile. If the question is answered incorrectly the player is not entitled to pick up any pieces. The question is opened up to the rest of the players in clockwise rotation and whoever answers correctly may pick up a piece from the pile. At the end of each turn the circular question card is returned to an aperture in the dispenser which is not the aperture from which a card was withdrawn.

As the invention progresses there may be times when the pieces a player collects may not be part of the overall portrait being sought. In this instance the pieces can be put to one side and used to return to the pile on a later turn. For example if a player answers a difficult question correctly and is lucky enough to pick two out of three pieces, they need, then they may return the unwanted piece collected on that turn plus another piece they have collected from a previous turn which was not required earlier.

As players try to complete their miniature portrait there may come a time when they need to retrieve a piece from another player. To do this they may request a 'Challenge' question when it is their turn. If this question is answered correctly then the player is entitled to take the piece from the other player. If the question is answered incorrectly they are not entitled to take the piece and the 'Challenge' question is opened up to other players. However, the player who answers correctly must take a piece from the middle pile at all times unless there are no pieces left, in which case they may take one they need from one of the other players. A player may also opt for a 'Challenge' question if they feel they have no knowledge of the celebrity featured on the question card that has been drawn for them on their turn.

If answered correctly they may pick up one jigsaw piece either from the middle pile or from another player.

Additional rules to the game played with the dispensing apparatus according to the invention may be devised. A player may slow an opponent down by using the 'Challenge' card. If correctly answered they may take one of their opponents jigsaw pieces that they are collecting. A player can only take a piece that is not attached to another by its side. They can however take a jigsaw piece that is attached by a corner. A middle jigsaw piece once collected by a player may never be taken. As before if the player trying to use this tactic answers incorrectly no jigsaw piece may be taken.

In an alternative variation of the game using a dispensing apparatus according to the present invention, there are 495 "In The Know" (RTM), question and answer cards each including at least one Challenge question per card. This variation is an example of a game relating to celebrities but it should be understood not to be limited to a celebrity question and answer game. Also forming the game are 54 jigsaw pieces that when completed form six celebrities, with each celebrity being composed of nine pieces. Also included are six cards that show the complete portrait of each celebrity on one side for reference and a star on the reverse of the card.

The object of the game is to be the first player/team to complete their selected celebrity portrait from the jigsaw pieces. This is achieved by correctly answering the questions from the question and answer cards.

To play the game, six portrait cards marked with a star on the reverse are taken and placed, face down, in no particular order. Each player then picks a card. This is now the celebrity portrait which that player/team has to complete. If under six players are taking, either the remainder of the cards can be put to one side or more than one portrait per player/team can be completed.

All the jigsaw pieces are removed from the top of the dispensing apparatus and loosely scattered, face down on a flat surface. Preferably, play follows a clockwise rotation.

If two players/teams are playing, are herein referred to as "A" and "B", for explanatory purposes; player "A" selects a celebrity question and answer card from the bottom slot of the dispensing apparatus and shows the picture on the card to player "B".

Player "B" must then decide as to how much knowledge he/she has of that particular celebrity and in the event that player "B" does not recognise the celebrity on the card, then player "A" is not obliged to inform player "B" of their identity. Based on their knowledge or lack of it player "B" chooses to answer question 1, 2 or 3 which are graded in varying degrees of difficulty i.e, question 1=Easy, question 2=Medium and question 3=Hard.

If the question is answered correctly player "B" is then entitled to pick up the number of jigsaw pieces corresponding to the question he/she has answered. For example, a correct question 1 allows them to pick up one piece of jigsaw, question 2, two pieces of jigsaw, and question 3, three pieces of jigsaw. Player "B" keeps all the pieces pertaining to the portrait he/she is completing. Other pieces collected on this turn not pertaining to the portrait they are tying to complete are returned face down to the pile. All the pieces that are kept, remain face up at all times in order that all players may see what has been played.

If the question is answered incorrectly, player "B" is not entitled to pick up any pieces. The question is then opened up to the rest of the players in clockwise rotation and whoever answers correctly may pick up one piece from the pile. At the end of the turn the question and answer card is returned to the slot at the top of the dispensing apparatus and it is the turn of player "B" to ask the next question.

In this variation of the game, during the course of the game, players may wish to take a gamble by slowing down an opponents portrait building. The opponent however, must have at least six pieces of completed jigsaw in order for them to be challenged. To challenge, a player must state their intention at the start of their turn thus forfeiting their right to answer a question. The player then takes a question card from the dispenser and asks the opponent to answer the challenge question. The challenge question is denoted on the celebrity question card by the bold typeface. If the challenge question is answered incorrectly the opponent must return the corresponding number of jigsaw pieces faced down to the pile. If the challenge question is answered correctly then the opponent can pick up the corresponding number of jigsaw pieces, for example, to the difficulty of the question answered, thus even further aiding the completion of their portrait. Each player is entitled to use one challenge question per game.

Changes to the rules of the variations of the game as described, for example to make a shorter game, can be to make a miss-match of a celebrity as long as the main features correspond with each other i.e. the hairline of any celebrity, the eyes of any celebrity, the nose of any celebrity and the mouth of any celebrity eg. the eyes of one, with the nose of another and the mouth of a third. Also it is possible to either play the game randomly or declare who is going for what picture at the start of the game. In an alternative embodiment instead of building up a celebrity portrait, a picture of any other image may be made, for example famous buildings, landmarks, animals, vehicles or any other subject may be used as the picture to be built. In these cases, question and answer cards are included which are relevant to the subject of the picture. It is envisaged that pieces for the game may be marketed in individual storage chambers which may be selectively used with the dispensing apparatus. A storage chamber, including desired pieces may be attached the dispensing apparatus in dependence on the subject matter that players wish to base the game upon.

Although the invention has been described with reference to a tubular dispenser, it is envisaged that a dispenser of other dimensions may be used provided that relative movement between a first and second part reveals at least two apertures through which access to contents contained in the dispenser may be gained.

What is claimed is:

1. A dispensing apparatus comprising at least two cylindrical parts (d,g), a first of said two parts (d) being releasably held within a second of said two parts (g), characterised by said first and second parts being moveable relative to one another in a helical fashion to display at least two apertures (i,f) leading to a chamber for retaining articles (b) which are to be dispensed from the apparatus, one of said apertures being in the first of said two parts (d) and the second aperture being in the second of said two parts (g), with said first aperture (i) being adjacent to a first end of the first part and said second aperture (f) being adjacent to a first end of the second part, said first and second apertures (i,f) being adjacent relatively opposed ends of said parts when one part is releasably held within the other, with the first part (d) also having access means to the chamber for retaining articles which is in proximity to the end of the second part having second aperture (f) and which on relative rotation of parts (d,g) said access means becomes aligned with aperture (f) so permitting access to the articles in the chamber.

* * * * *